United States Patent [19]

Temple

[11] 4,202,408

[45] May 13, 1980

[54] JET TYPE HEAT EXCHANGER

[76] Inventor: Robert S. Temple, P.O. Box 562, West Acton, Mass. 01720

[21] Appl. No.: 883,875

[22] Filed: Mar. 6, 1978

[51] Int. Cl.[2] ..... F28F 13/12

[52] U.S. Cl. ..... 165/109; 165/164; 165/DIG. 11

[58] Field of Search ..... 165/DIG. 11, 109, 109 T, 165/164; 34/160, 156

[56] References Cited

U.S. PATENT DOCUMENTS

| | | | |
|---|---|---|---|
| 2,042,610 | 6/1936 | Littleton | 34/160 |
| 2,591,621 | 4/1952 | Shegda | 34/156 |
| 2,894,334 | 7/1959 | Thygeson, Sr. | 34/160 |
| 3,070,901 | 1/1963 | Allander et al. | 34/160 |
| 3,109,485 | 11/1963 | Fortier | 165/DIG. 11 |
| 3,319,354 | 5/1967 | Hering, Jr. et al. | 34/160 |
| 3,324,570 | 6/1967 | Flaith et al. | 34/156 |
| 3,680,218 | 8/1972 | Belue et al. | 34/156 |
| 3,827,639 | 8/1974 | Relue et al. | 34/156 |
| 3,929,941 | 12/1975 | Horne | 261/154 |
| 4,108,242 | 8/1978 | Searight et al. | 165/DIG. 11 |

FOREIGN PATENT DOCUMENTS

| | | | |
|---|---|---|---|
| 2234395 | 1/1974 | Fed. Rep. of Germany | 165/DIG. 11 |
| 1356114 | 6/1974 | United Kingdom | 34/160 |

OTHER PUBLICATIONS

More Efficient Drying, 8–77 Issue of *Dyeing and Finishing*, pp. 22–23.

*Primary Examiner*—Sheldon Richter

[57] ABSTRACT

An impingement type heat exchanger in which jets of fluid are directed against opposite sides of a corrugated transfer plate that is generally perpendicular to the direction of fluid flow through the jets.

18 Claims, 6 Drawing Figures

FIG 2
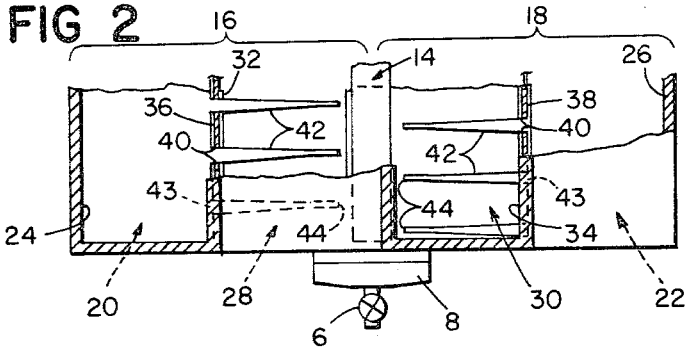
FIG 3
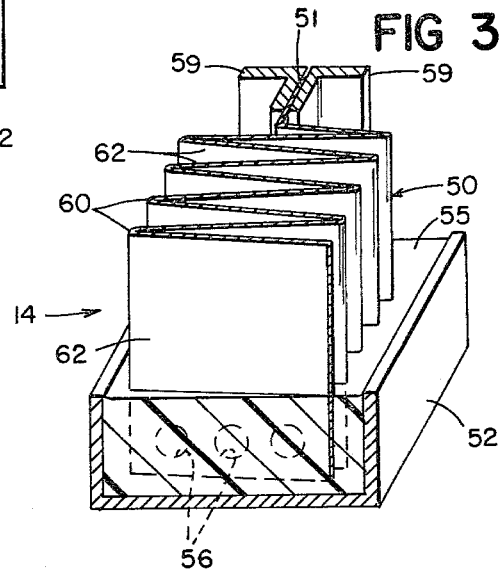
FIG 4
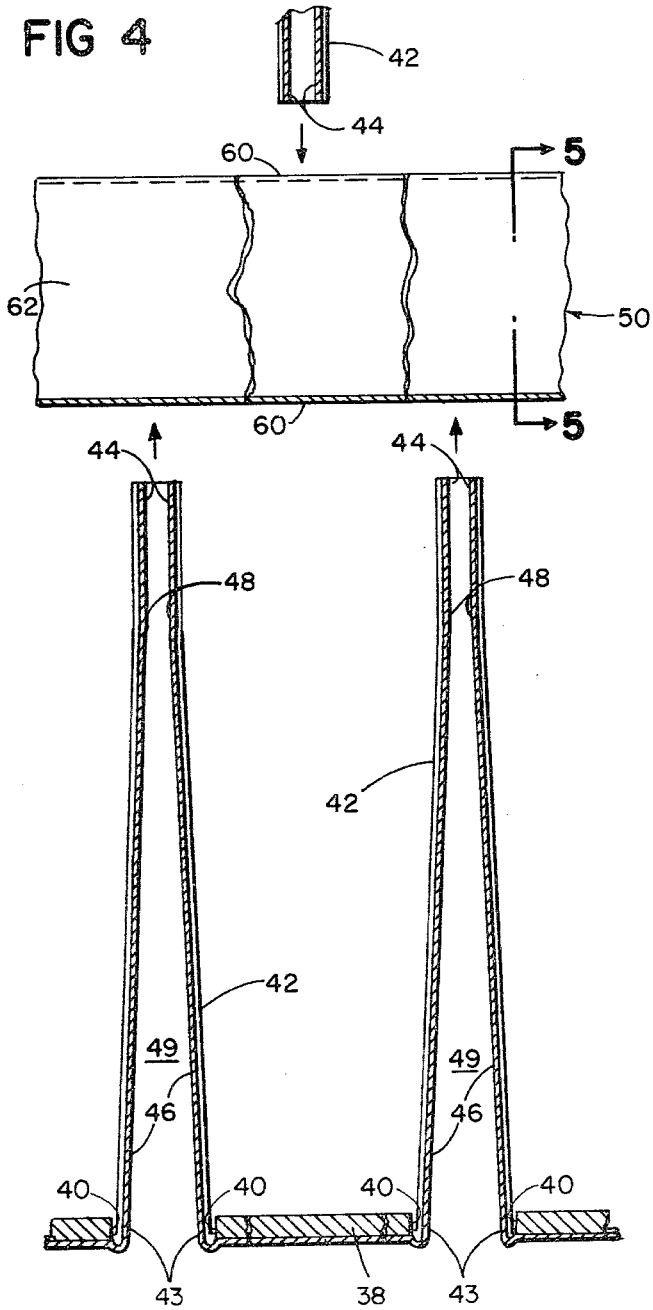
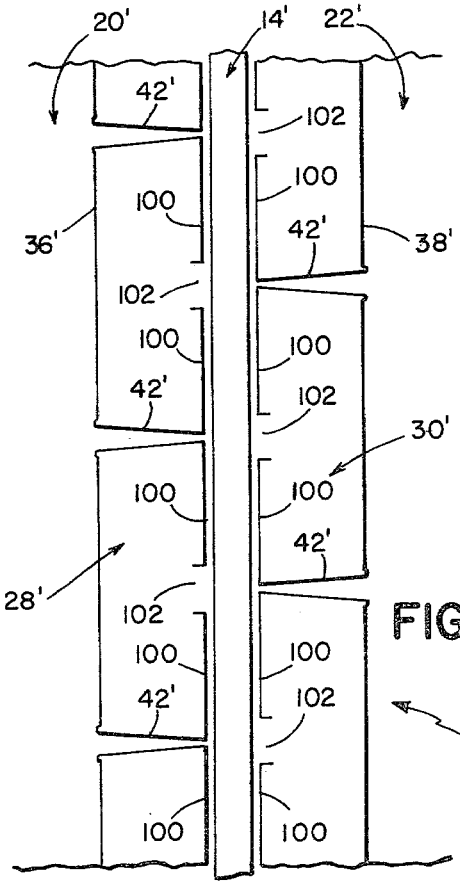
FIG 6

JET TYPE HEAT EXCHANGER

Field of the Invention

This invention relates to heat exchangers.

BACKGROUND OF THE INVENTION

It has long been desirable to provide efficient, simple and relatively inexpensive fluid to fluid heat exchangers. British Patent Specification No. 1,356,114, published June 12, 1974, discloses an impingement type exchanger in which a plurality of tubular nozzles direct hot and cold air perpendicularly against opposite sides of an intermediate heat exchanger wall. Opposed longitudinal air jets have been used to dry fabric webs, as disclosed in U.S. Pat. No. 3,827,639 to Belue et al., issued Aug. 6, 1974.

SUMMARY OF THE INVENTION

I have discovered that the efficiency of an impingement type heat exchanger can be greatly increased if the jets direct fluid against the opposite sides of a corrugated transfer plate that is generally perpendicular to the direction of fluid flow through the jets. In preferred air-to-air heat exchangers, slot jets on one side of the plate are offset relative to slot jets on the other side of the plate, the corrugations are perpendicular to long axes of the slots, the corrugations form flat pleats the tips of which are rounded on a radius of not less than about 1/16 in. and the interior angle between adjacent pleat sides is less than about 10 degrees.

DESCRIPTION OF THE DRAWINGS

The drawings show preferred embodiments of the invention. In the drawings:

FIG. 2 is a plan view of a portion of the preferred embodiment;

FIG. 3 is a perspective view of a portion of the pleated transfer plate;

FIG. 4 is a plan view, somewhat schematic, of jets opposed on opposite sides of the transfer plate;

FIG. 6 is a sectional view of portions of a modified embodiment.

DESCRIPTION OF THE PREFERRED EMBODIMENT

Figure 1:
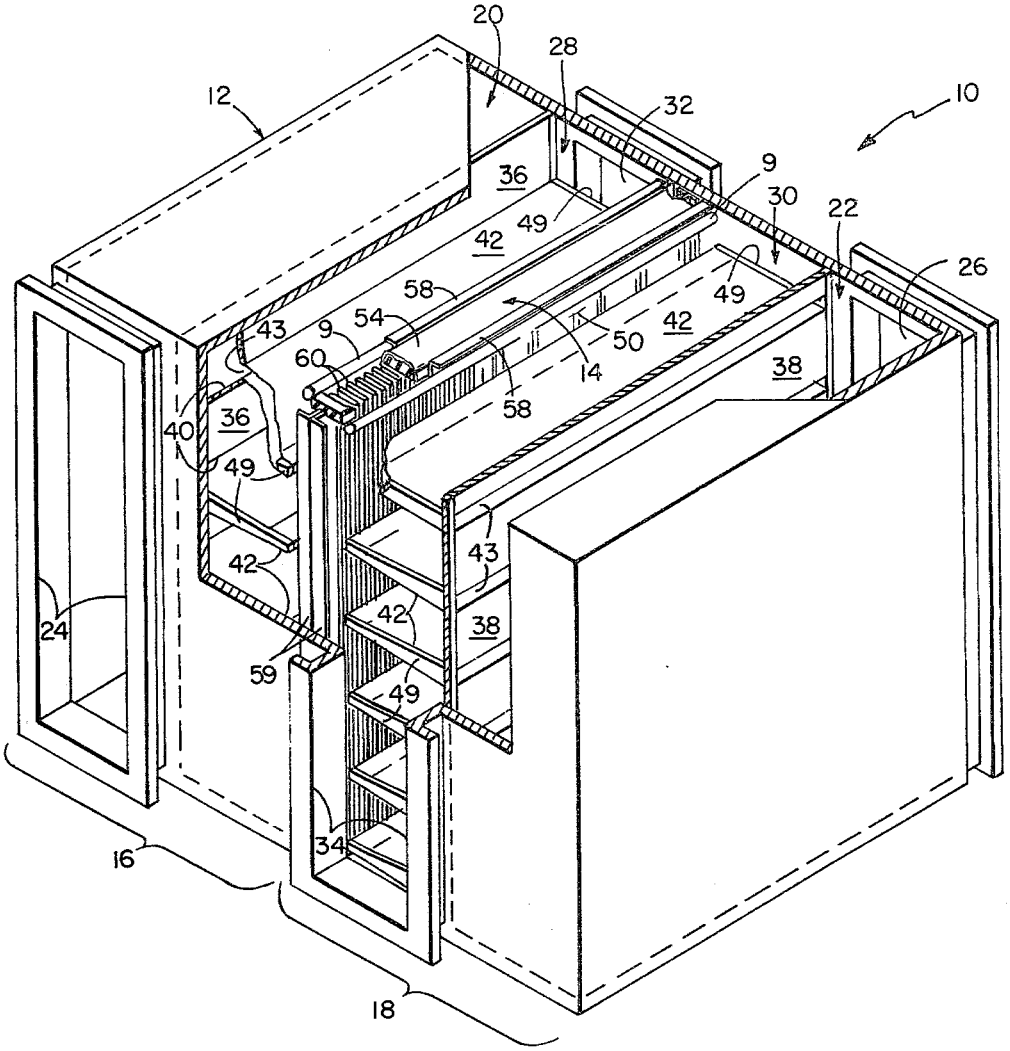
FIG. 1 is a perspective view, partially cutaway, of the preferred embodiment.

FIGS. 1–5 of the drawings show a 2,000 c.f.m. air-to-air heat exchanger, generally designated 10, comprising a sheet metal enclosure 12 (about 48 inches (122 cm) wide and 36 inches (91.4 cm) high and deep) divided generally in half, into a hot air side 16 and a cold air side 18, by a corrugated vertical heat transfer plate 14. Each side of the heat exchanger includes a supply plenum 20, 22, about 12 in. (30.5 cm) wide, 36 in. (91.4 cm) high and 36 in. (91.4 cm) long, one end of which defines an inlet, designated 24, 26, respectively. Between supply plenums 20, 22, and separated by heat transfer plate 14, are hot side and cold side return and slot jet sections 28, 30, each of which is similarly about 12 in. (30.5 cm) wide, 36 in. (91.4 cm) long and 36 in. (91.4 cm) high and has at one end a respective outlet 32, 34. A spray pipe 9, for cleaning the transfer plate with steam or water, and detergent, is positioned along the top of each side of transfer plate 14. A drain pan 8 and plug 6 below transfer plate 14 permit the removal of the cleaning spray and of condensates.

The common wall 36, 38 between each plenum and its associated return and slot jet section includes a lattice defining a plurality of horizontal slots 40, each about 1 in. (2.5 cm) wide and spaced on about 6 in. (15.2 cm) centers, extending substantially the full width of the respective wall 36, 38. Generally U-shaped pieces of sheet metal are mounted in the lattice work to provide a plurality of longitudinally extending jets 42. Five jets are provided in wall 36 of hot sections 16; six jets are mounted in cold section wall 38. The inlet 43 and outlet 44 of each jet are rectangular and extend substantially the full three foot (91.4 cm) depth of enclosure 12, and the outlet 44 of each jet is about 1 in. (2.5 cm) from the nearest portion of transfer plate 14. As shown in FIG. 4, each jet 42 is in cross-section about 10 in. (25.4 cm) long (from inlet to outlet), has an inlet width (at inlet 43) of about 1 in. (2.5 cm), and has an outlet width (at outlet 44) of about ⅜ in. (1.0 cm). The sides 46 of the jet uniformly converge, from 1 in. (2.5 cm) spacing, the jet inlet 43, to ⅜ in. (1.0 cm) spacing at a point 2 in. (5.1 cm) from the ⅜ in. (1.0 cm) orifice. The 2 in. (5.1 cm) wide portions 48 of the jet sides nearest the outlet orifice are parallel. The opposite ends of each jet, adjacent the inside end walls of the enclosure 12, are sealed by end caps 49. As shown in FIGS. 2 and 4, the jets on hot air side 16 are vertically offset 3 in. (7.6 cm) relative to the jets on cold air side 18, so that the jets on the two sides are midway between rather than directly opposed to each other.

Heat transfer plate 14 is a thin (0.005 to 0.010 in., 0.013 to 0.025 cm) sheet 50 of metal (typically copper, stainless steel or aluminum although conductive plastics may be used in some circumstances) the corrugations in which form a plurality of flat-sided vertical pleats. The top and bottom of the pleats are cast into metal support pans 52, 54 each about 4 in. (10.2 cm) wide and 1 in. (2.5 cm) deep with high temperature plastisol 55. Holes 56 are punched in the portions of each pleat within the respective pans to enchance the bond with the plastisol. Pan 52 is fixed to the bottom of enclosure 12. Pan 54 is held between a pair of metal seal plates 58 attached to the top and extending between the sides of enclosure 12 with the top of the pan spaced slightly below the top of enclosure 12. Plates 58 engage the sides of the pan and permit the pan to move as sheet 50 expands and contracts. As should be evident, pans 52, 54 and plates 58 provide air seals at the top and bottom of transfer plate 14. The sides of the plate are sealed, as best shown in FIG. 3, by side portions 51 of sheet 50 brought through the ends of boxes 52, 54 and clamped between vertical angle brackets 59 on the sides of enclosure 12.

Figure 5:
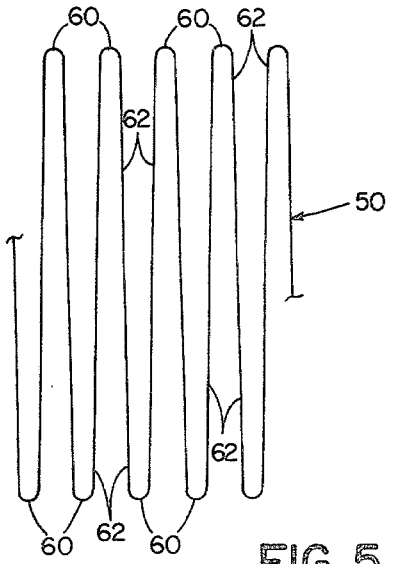
FIG. 5 is a sectional view taken at 5—5 of FIG. 4.

The configuration of the pleats of sheet 50 is most clearly shown in FIG. 5. As there illustrated, each pleat is 3 in. (7.6 cm) deep (tip to tip), the distance between the tips 60 of adjacent pleats is ⅜ in. (1.0 cm), and each tip is formed on an inside radius of ⅛ in. (0.3 cm). The two sides 62 of each pleat form an angle of about 3 degrees with each other, and the distance between sides at the open end of the pleat is about ¼ in. (0.6 cm). The total surface area of the corrugated, e.g., pleated, sheet is about 150 square feet (14 sq. meters). As will be seen, the corrugations, i.e., the tips of the pleats, are perpendicular to the long dimensions of jet outlet orifices 43, and the pleat tips and jet outlet orifices lie in generally parallel planes.

In operation, hot air (500° F., 260° C.) is introduced into inlet 24 of hot air plenum 20, and cold air (40° F., 5° C.) is forced into inlet 26 of cold air plenum 22, both at the rate of about 2000 c.f.m. (944 liters per second). The air flows through jets 42, exiting from the jets with a design velocity of about 3000 feet per minute (915 meters per minute), and impinges on the pleats of heat transfer sheet 50. The shape of the pleats and the high velocity of the angularly impinging air together cause efficient heat transfer between the air and the pleated transfer sheet; and the thinness and high conductivity of sheet 50 causes good heat flow between its hot and cold sides. The jet flow puts large amounts of turbulent air into contact with the surfaces of the pleats; the angularly impinging air scrubs away laminar surface films on the pleat surfaces; and the reflection from the surfaces and reduction in volume as the air penetrates deeper into the pleat both contribute to air turbulence. Air streams from adjacent slot jets collide and cause continuing turbulence as air exits from the pleat and flows to outlets 32, 34.

OTHER EMBODIMENTS

The heat exchanger 10' partially shown in FIG. 6 includes a number of baffle plates 100 mounted parallel to and spaced slightly from the corrugated heat transfer plate 14'. Each baffle plate abuts and extends from the side of the outlet orifice of a slot jet 42'. The pair of plates between each pair of slot jets 42' defines, midway between the pair of slot jets and opposite the slot jet on the other side of transfer plate 14', a rectangular port 102. Similar ports (not shown) adjacent the top and bottom of the heat exchanger are defined by the plates 100 extending, respectively, upwardly and downwardly from the top and bottom jets on each side of transfer plate 14'. All of the plates and ports extend the full width of the heat exchanger. As will be seen, baffles 100 control fluid from jets 42' and force it to flow in close contact with the corrugations of transfer plate 14' from the jet outlets to the adjacent port 102. Such control is especially useful when it is desired for the output fluid from the cold side of the heat exchanger to be relatively hot. The distance of the baffles from the heat transfer plate and the width of the ports 102 will, of course, depend on the particular circumstances, including the desired back pressure between the baffles and transfer plate. In the illustrated embodiment, the baffle plates are about ¼ in. from the heat transfer plate and ports 102 are about 2 in. wide.

In other embodiments, both the structure of the heat exchanger and the fluids with which it is used may vary widely. For example, the fluids into the hot and cold sides may be different, and either or both may be a gaseous fluid, i.e., a gas or vapor, other than air, or a liquid such as water. The temperature, density, and contaminant content of any particular fluid similarly may vary over a wide range. In some applications, the fluid could be the exhaust of a flash freezer (about −50° F.); in others, furnace exhausts (about 1600° F. and toxic) would be used. Generally the temperatures of the fluids will be in the range of about 20 to about 500 degrees F.

In structure, the size of the jets will be changed as required to obtain the desired jet outlet velocity (generally 1500 to 6000 fpm and, typically, in the range of 2000 to 3000 fpm) and fluid-transfer sheet interaction, as will the configuration of the pleats or other corrugations, the spacing between jets and the distance from the jet outlets to the corrugated sheet. Clean, dry and low density fluids require relatively narrow pleats, small openings and small clearances (such as those of the described preferred embodiments), while wider orifices and/or corrugations (and also stronger sheet materials) and greater nozzle-to-nozzle and nozzle-to-sheet spacing will be used in applications involving dirty fluids with viscous contaminants. With water, the jet openings are much narrower than with gaseous fluids, the sides of the jets should be insulated, and a much lower flow rate can be used.

The width of the jet discharge orifice in typical gaseous fluid exchangers will be in the range of 1/32 in. (0.08 cm) to 1 in. (2.5 cm), the spacing between jets will be between 2 in. (5 cm) and 12 in. (30.5 cm), and the distance from the jet outlet to the sheet will be from ¼ in. (0.6 cm) to 2 in. (5 cm). Jet spacing and distance from the jet to the sheet are dependant principally on the width of the jet's orifice, the length of the throat of the jet, and the velocity and density of the gaseous fluid. The radius on which the tips of the pleats is formed will be not less than about 1/16 in., and typically will be about ⅛ in. as in the described embodiment.

If desired, epoxy rather than plastisol may be used to bond the top and bottom of the corrugated conductive sheet 50 in place in pans 52, 54; and when epoxy is used holes 56 are generally unnecessary.

These and other embodiments will be within the scope of the following claims.

I claim:

1. A heat exchanger including a heat transfer sheet dividing an enclosure into a hot side and a cold side each having a jet nozzle for directing a jet of fluid generally perpendicularly against the respective side of said sheet, said exchanger being characterized in that:

said heat transfer sheet comprises a thin pleated sheet of thermally conductive material, the pleats having generally planar sides which diverge and form interior angles of not more than about 10° and the tips of the pleats lying in planes generally perpendicular to the direction of flow of the jets of fluid; and, each of said nozzles is positioned relative to said sheet such that fluid of the jet from the nozzle is directed between and impinges of an acute angle on the generally facing planar side of a pleat of the sheet.

2. The heat exchanger of claim 1 including a plurality of said nozzles on each side of said sheet and further characterized in that the jet nozzles on one side of said sheet are offset relative to the nozzles on the other side of said sheet.

3. The heat exchanger of claim 1 further characterized in that each of said jet nozzles has an outlet orifice of length at least twice its width and is positioned with the length of its outlet orifice extending generally perpendicular to the pleats of said sheet.

4. The heat exchanger of claim 1 further characterized in that the pleats of said sheet form interior angles of not more than about 3 degrees.

5. The heat exchanger of claim 1 further characterized in that the tips of said pleats are formed on an inside radius not less than about 1/16 inch.

6. The heat exchanger of claim 1 further characterized in that a plurality of said nozzles are provided on each side of said sheet, each of said nozzles has a generally rectangular outlet orifice, said nozzles are positioned with their orifices generally parallel to each other, the planar sides and tips of said pleats are generally vertical, and the long dimensions of said orifices extend generally perpendicular to the tips of the pleats of said sheet.

7. The heat exchanger of claim 6 further characterized in that each of said nozzles has a generally rectangular inlet orifice and a generally rectangular outlet orifice of width less than one-half that of said inlet orifice thereof.

8. The heat exchanger of claim 7 further characterized in that each of said nozzles is of substantially constant cross-sectional arm for a distance extending not less than 1 inch upstream from the outlet orifice thereof.

9. The heat exchanger of claim 1 further characterized in that the depth of each of said pleats is in the range of 1 to 12 inches.

10. The heat exchanger of claim 9 further characterized in that said depth is about 3 inches, and the tips of said pleats are formed on an inside radius not less than about 1/16 inch.

11. The heat exchanger of claim 1 further characterized in that the distance from each of said nozzles to said sheet is in the range of ¼ in. to 2 inches.

12. The heat exchanger of claim 1 further characterized in that a plurality of said nozzles are provided on each side of said sheet, the distance between adjacent ones of said nozzles on a said side being in the range of 2 in. to 12 inches.

13. A heat exchanger including a heat transfer sheet dividing an enclosure into a hot side and a cold side each having a jet nozzle for directing a jet of fluid generally perpendicularly against a respective side of said sheet, said exchanger being characterized in that:

said heat transfer sheet comprises a thin pleated sheet of thermally conductive material, each of the pleats including a pair of generally planar sides diverging from a rounded tip, the tips of the pleats lying in planes generally perpendicular to the direction of flow of the jets of fluid; and each of the nozzles has an orifice of length measured transversly of the tips of said pleats greater than the maximum width of a said pleat and is positioned such that fluid of the jet from the nozzle is directed into a plurality of said pleats and impinges angularly on the generally facing planar surfaces of each of said plurality of pleats.

14. A heat exchanger including a heat transfer sheet dividing an enclosure into a hot side and a cold side each having a jet nozzle for directing a jet of fluid generally perpendicularly against the respective side of said sheet, said exchanger being characterized in that:

said heat transfer sheet comprises a thin pleated sheet of thermally conductive material, the tip of pleats lying in planes generally perpendicular to the direction of flow of the jets of fluid;

a fluid flow control plate is mounted on one side of said transfer sheet closely adjacent and generally parallel thereto;

said nozzle directs said jet through a first opening in said flow control plate; and, a second opening in said flow control plate permits flow of fluid from between said flow control plate and transfer sheet.

15. The heat exchanger of claim 14 including a fluid control plate on each side of said transfer sheet and further characterized in that a plurality of said nozzles are provided on each side of said transfer sheet, each of said nozzles has a rectangular orifice extending generally perpendicular to the tips of the pleats of said sheet, each of said nozzle directs through a respective first opening in a said flow control plate, and a said second opening is provided between each pair of nozzles.

16. A heat exchanger including a heat transfer sheet dividing an enclosure into a hot side and a cold side each having at least two spaced jet nozzles for directing generally parallel jets of fluid generally perpendicularly against one said sheet, said exchanger being characterized in that:

said heat transfer sheet comprises a thin pleated sheet of thermally conductive material, the tip of the pleats lying in planes generally perpendicular to the direction of flow of the jets of fluid;

a fluid flow control plate is mounted on said one side of said transfer pleat intermediate said nozzles on said one side, and closely adjacent and generally parallel to said heat transfer sheet;

said nozzles on said one side direct jets of fluid into the space between said flow control plate and said heat transfer sheet; and an opening in said flow control plate intermediate said nozzles on said one side permits flow of fluid from said space between said flow control plate and said heat transfer sheet.

17. The heat exchanger of claim 16 including a said fluid control plate and at least two said nozzles on each side of said transfer sheet.

18. The heat exchanger of any of claims 14–16 further characterized in that each of the nozzles is positioned relative to the pleats of the heat transfer sheet such that fluid of the jet from the nozzle is directed between and impinges angularly on the generally facing surfaces of the pleats of the sheet.

* * * * *